United States Patent [19]

North

[11] Patent Number: 4,894,120

[45] Date of Patent: Jan. 16, 1990

[54] TWIN WIRE FORMING APPARATUS

[75] Inventor: Merle W. North, Beloit, Wis.

[73] Assignee: Beloit Corporation, Beloit, Wis.

[21] Appl. No.: 127,525

[22] Filed: Dec. 2, 1987

Related U.S. Application Data

[63] Continuation of Ser. No. 878,964, filed as PCT US86/00975 on Apr. 30, 1986, published as WO87/06637 on Nov. 19, 1987, abandoned.

[51] Int. Cl.[4] ..... D21F 1/00

[52] U.S. Cl. ..... 162/301; 162/203; 162/300

[58] Field of Search ..... 162/300, 301, 303, 348, 162/203, 205, 208, 211

[56] References Cited

U.S. PATENT DOCUMENTS

| | | | |
|---|---|---|---|
| 3,438,854 | 4/1969 | Means | 162/303 |
| 3,846,233 | 11/1974 | Kankaanpaa | 162/301 |
| 3,855,057 | 12/1974 | Hill | 162/301 |
| 4,125,428 | 11/1978 | Phelps | 162/301 |
| 4,153,504 | 5/1979 | Justus | 162/301 |
| 4,209,360 | 1/1980 | Stenberg | 162/301 |
| 4,417,950 | 11/1983 | Bubik et al. | 162/300 |
| 4,532,008 | 7/1985 | Creagan et al. | 162/301 |
| 4,557,802 | 12/1985 | Waris | 162/301 |
| 4,609,435 | 2/1986 | Tissari | 162/301 |

FOREIGN PATENT DOCUMENTS

| | | | |
|---|---|---|---|
| 3222428 | 12/1983 | Fed. Rep. of Germany | 162/301 |
| 1336713 | 11/1973 | United Kingdom | 162/301 |

*Primary Examiner*—Karen M. Hastings

*Attorney, Agent, or Firm*—Dirk Veneman; Raymond Campbell; David Archer

[57] ABSTRACT

A forming apparatus (10) is disclosed for forming a web from stock. The apparatus (10) includes a frame (14) and a first and second plurality of guide rolls (16–26 and 30–34) rotatably connected to the frame (14). A first and second forming wire (28,36) extend respectively around the first and second plurality of guide rolls, with the first and second wires (28,36) cooperating together to define therebetween, a forming section (38) having a first and second (40,42) end. A headbox (12) is disposed adjacent to the first end (40) of the forming section (38). A suction shoe (44) is disposed adjacent to the first end (40) of the forming section for effecting an initial dewatering of the web. The suction shoe (44) has a curved surface (46) which abuts against the first wire (28) for removing a first portion of the water through the first wire (28) and a second portion of the water through the second wire (36). A vacuum slot (52) collects the second portion of water and a roll (17) is disposed between the vacuum slot (52) and the second end (42) of the forming section (38) for removing a third portion of the water from the formed web thereby resulting in a gradual increase in dewatering from the first to the second end of the forming section (38) thereby minimizing removal of fines from the stock and inhibiting two-sidedness of the resultant web.

9 Claims, 4 Drawing Sheets

TWIN WIRE FORMING APPARATUS

This is a continuation of co-pending application Ser. No. 878,964 filed as PCT US86/00975 on Apr. 30, 1986, published as W087/06637 on Mar. 19, 1987, now abandoned.

BACKGROUND OF THE INVENTION

1. Field of the Invention

This invention relates to a forming apparatus for forming a web from stock. More particularly, this invention relates to a forming apparatus for forming a web of paper in the forming section of a papermaking machine.

2. Information Disclosure Statement

For many years, paper webs were formed by depositing a jet of pulp, or stock, onto a moving fourdrinier wire. Excess water within the deposited stock was drained through the fourdrinier wire by various dewatering means including suction boxes.

Paper webs formed as a result of the foregoing fourdrinier forming process resulted in a finished paper product exhibiting a certain two-sidedness in that the water, during formation, had been drained in one direction only. Such two-sidedness presented a finished sheet having different surface characteristics on each side of the sheet thereby causing printing problems.

More recently, various twin wire formers have been proposed which have enabled the dewatering of web in both directions simultaneously. Such twin wire formers have greatly increased the quality of the resultant paper product by providing a web having fairly uniform surface characteristics on both sides thereof.

However, many twin wire formers are disposed as retrofits above an existing fourdeinier forming section. In such retrofitted machines, the jet from the headbox is deposited on the moving fourdrinier wire and usually travels a considerable distance prior to entering the forming section defined by the cooperating bottom and top wire. During the movement of the wire prior to movement between the cooperating bottom and top wires, the web is subjected only to bottom drainage. Such bottom drainage has resulted in certain inherent characteristics of the resultant paper web and these characteristics have, to a large degree, been undesirable.

More specifically, during drainage of the web on the open wire between the headbox and the top wire when forming paper for newsprint, relatively high linting has resulted therefrom due to such bottom drainage. Furthermore, certain speed limitations have been imposed by the aforementioned open wire section and, to a degree, fines within the paper stock are unevenly distributed throughout the resultant web.

Additionally, in such twin wire formers, it is difficult to apply a gradual dewatering action to the stock so that the resultant web maintains therein, most of the fines that were suspended in the stock.

These, and other problems, are overcome by the apparatus of the present invention.

Consequently, it is primary objective of the present invention to provide a forming apparatus that overcomes the aforementioned inadequacies of the prior art machines and to provide a forming apparatus which contributes a significant improvement to the art of paper formation.

Another objective of the present invention is the provision of a forming apparatus in which the stock is subjected simultaneously to a gradual increase in dewatering action between the first and second ends of the forming section.

Another objective of the present invention is the provision of a forming apparatus in which the jet of stock is ejected directly into the forming section defined between a first and a second forming wire.

Another objective of the present invention is the provision of a forming apparatus in which the jet of stock is directed slightly towards the lower forming wire.

Another objective of the present invention is the provision of a forming apparatus including a first and second cooperating wire with a suction shoe disposed below the first wire and adjacent to the first end of the forming section for dewatering the web downwardly.

Another objective of the present invention is the provision of a dewatering shoe having a large radius of curvature such that a first portion of water is removed through the first wire and a second portion of water is removed upwardly through the second wire.

Another objective of the present invention is the provision of a forming apparatus including a suction slot for removing the second portion of water.

Another objective of the present invention is the provision of a suction roll disposed below the first wire with the roll having a radius of curvature which is less than the radius of curvature of the suction shoe such that a third portion of water is removed from the stock through the second wire.

Another objective of the present invention is the provision of a forming apparatus in which the roll is a grooved roll.

Another objective of the present invention is the provision of a forming apparatus in which the roll is disposed above the second wire such that the third portion of water is removed through the first wire.

Other objects and advantages of the present invention will be readily apparent to those skilled in the art by considering the information contained in the annexed drawings and the detailed description and as defined by the appended claims.

SUMMARY OF THE INVENTION

The present invention relates to a forming apparatus and method for forming a web of paper from paper stock. The apparatus includes a frame means and a plurality of guide rolls rotatably connected to the frame means. A first continuous forming wire extends around, and is guided by, the first plurality of rolls. The second plurality of guide rolls is rotatably connected to the frame means and a second continuous wire extends around, and is guided by, the second plurality of rolls. The first and second wires cooperate together to define therebetween a forming section in which the web is formed, the forming section having a first and a second end. A headbox is disposed adjacent to the first end of the forming section such that the stock is ejected from the headbox towards the first end of the forming section so that the stock moves together with, and between, the wires and along the forming section in a direction from the first towards the second end of the forming section. A dewatering shoe is disposed adjacent to the first end of the forming section for dewatering the web. The dewatering shoe defines a curved surface which abuts against the first wire. The curved surface has a center of curvature which is disposed on the opposite side of the first wire relative to the second wire such that the first portion of water is removed from the stock through the first wire and a second portion of water is removed from the stock through the second wire due to the centrifugal force of the stock moving along the curved surface. A suction slot is disposed adjacent to the second wire for collecting the second portion of water. A roll means is disposed between the suction slot collector means and the second end of the forming section. The roll means has a radius of curvature which is less than the radius of curvature of the dewatering means so that a third portion of water is removed from the stock as the stock passes around the roll means such that the dewatering of the stock from the first toward the second end of the forming section gradually increases so that the removal of fines from the stock is minimized and two-sidedness of the resultant web is inhibited.

More specifically, in a first embodiment of the present invention, the roll means is a suction roll whereas in a second embodiment of the present invention, the roll means is a polymeric-covered, grooved roll.

In another embodiment of the present invention, instead of the roll means being disposed beneath the first wire, the roll means is disposed above the second wire such that as the second wire passes around the roll means, the third portion of water is removed from the stock through the first wire.

The detailed description of the present invention as disclosed hereinafter describes the various embodiments of the present invention. However, the present invention envisages many variations and alternative arrangements that fall within the spirit and scope of the present invention as defined by the appended claims. These variations and modifications will be readily apparent to those skilled in the art from a consideration of the drawings and disclosure of the present application. Such modifications and variations of the basic concept of the present invention do not depart from the spirit and scope of the present invention which is defined by the appended claims.

BRIEF DESCRIPTION OF THE DRAWINGS

Similar reference characters refer to similar parts throughout the various embodiments of the present invention.

DETAILED DESCRIPTION

Figure 1:
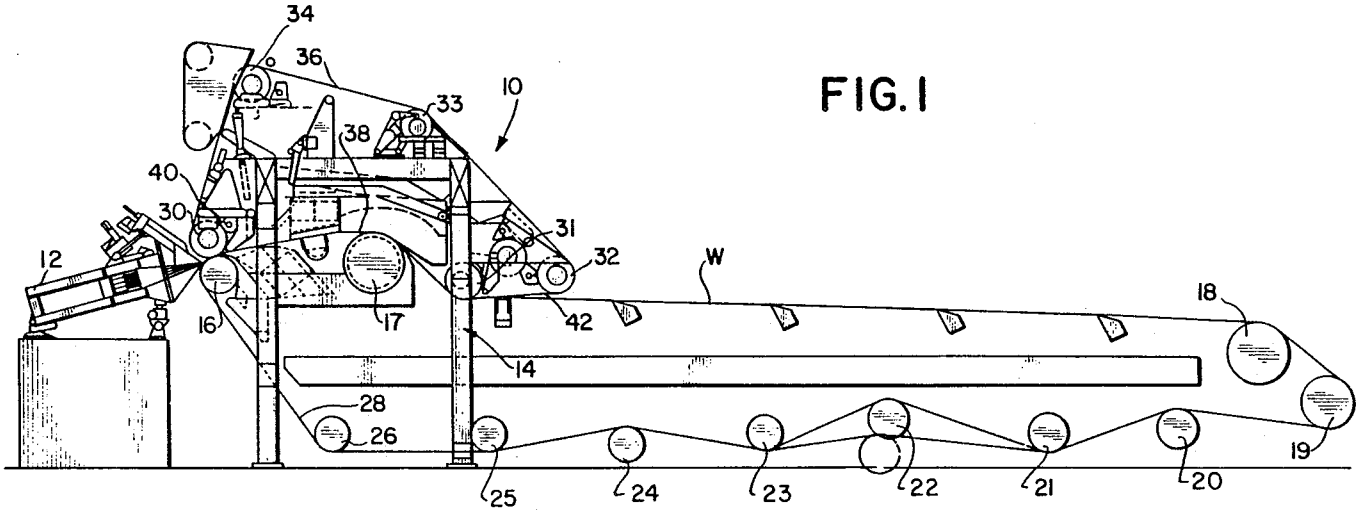
FIG. 1 is a side elevational view of the forming apparatus of the present invention.

FIG. 1 shows a forming apparatus generally designated 10 for forming a web W from stock contained within a headbox 12. The apparatus 10 includes a frame means generally designated 14 and a first plurality of guide rolls, 16,17,18,19,20,21,22,23, 24,25 and 26 which are rotatably connected to the frame means 14. A first continuous forming wire 28 extends around the guide rolls 16 to 26. A second plurality of guide rolls, 30, 31,32,33 and 34 are rotatably connected to the frame means 14. A second continuous forming wire 36 extends around, and is guided by, the second plurality of rolls 30 to 34. The first and second wires 28 and 36 cooperate together to define therebetween, a forming section 38 in which the web W is formed. The forming section 38 has a first and second end 40 and 42 respectively. The headbox 12 is disposed adjacent to the first end 40 of the forming section 38 such that stock is ejected from the headbox 12 toward the first end 40 of the forming section 38 so that stock travels between the first and second wires 28 and 36 and along the forming section 38.

Preferably, the headbox 12 is a hydraulic headbox which delivers a uniform jet of stock. The headbox 12 is preferably disposed less than 13 inches (33 centimeters) from the first end 40 of the forming section 38. Ideally, the headbox 12 is disposed 12 inches or less from the first end 40 of the forming section 38. The jet of stock impinges onto the first wire 28 prior to the second wire 36 and, in the preferred embodiment of the present invention, the jet is arranged to impinge onto the first wire 28 at an angle within the range 1 to 5 degrees relative to the forming section 38 adjacent to the first end 40 of the forming section 38.

Figure 2:
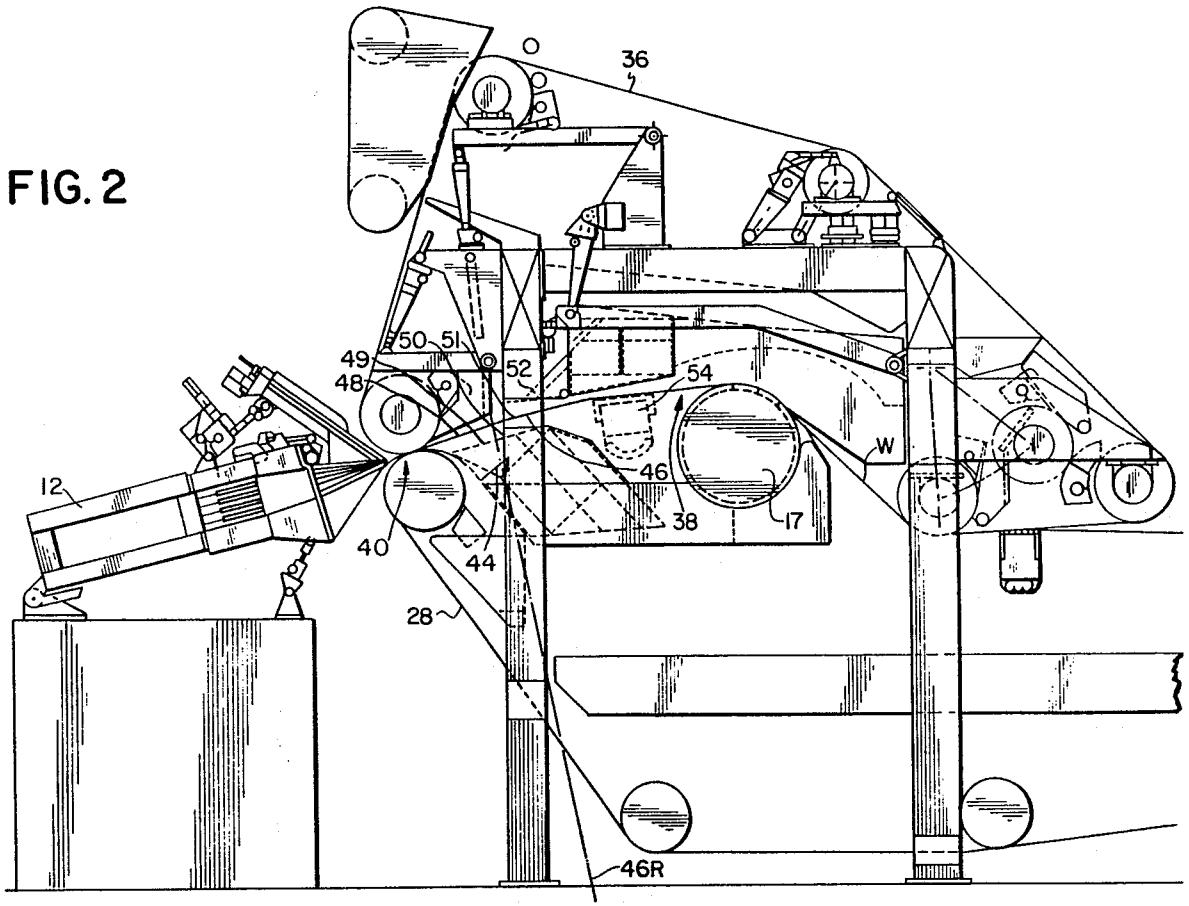
FIG. 2 is an enlarged side elevational view of a portion of the apparatus shown in FIG. 1.

FIG. 2 is an enlarged side view of the forming section 38 and shows a dewatering means, or suction shoe, generally designated 44 which is disposed adjacent to the first end 40 of the forming section 38. The dewatering means 44 is disposed adjacent to the first wire 28 with the first wire 28 and the formed web W disposed between the dewatering means 44 and the second wire 36. The dewatering means 44 defines a curved surface 46 which has a center of curvature 46R. The surface 46 has a radius of curvature in the order of 200 inches (508 centimeters) with such center of curvature 46R being disposed on the opposite side of the web W relative to the second wire 36. The curved surface 46 defines a plurality of drainage holes 48,49,50 and 51 such that water within the web W drains through the first wire 28 and through the holes 48 to 51 for effecting initial dewatering of the formed web W. Such drainingе of water from the stock is assisted by a partial vacuum which is connected to the dewatering means 44. Preferably a partial vacuum of between 10 to 20 inches of water is applied to the dewatering means 44. While a first portion of water is removed from the stock by means of drainage and suction through the dewatering means 44 it is evident that due to the curved surface 46 and movement of the stock between the wires 28 and 36 around such curved surface 46, a second portion of water within the stock will be thrown by centrifugal force upwardly through the second wire 36 where such second portion will be removed by means of a collector means 52 disposed adjacent to the second wire 36. The collector means 52 is a vacuum slot which is disposed above the dewatering means 44 between the first and second ends 40 and 42 respectively of the forming section 38.

In a first embodiment of the present invention as shown in FIG. 2, a roll means 17 is a suction roll which is disposed between the collector means 52 and the second end 42 of the forming section 38. The roll means 17 has a radius of curvature which is less than the radius of curvature of the dewatering means 44. The roll means 17 is disposed on the same side of the first wire 28 as the dewatering means 44. That is, the roll means 17 is disposed under the first wire 28 such that when the first wire 28 moves around the roll means 17, a third portion of water is removed from the stock through the second wire 36 as the stock passes around the roll means 17. By such an arrangement, the dewatering of the stock between the first toward the second end of the forming section 38 gradually increases so that removal of fines contained within the stock is minimized and two-sidedness of the resultant web is inhibited.

Figure 3:
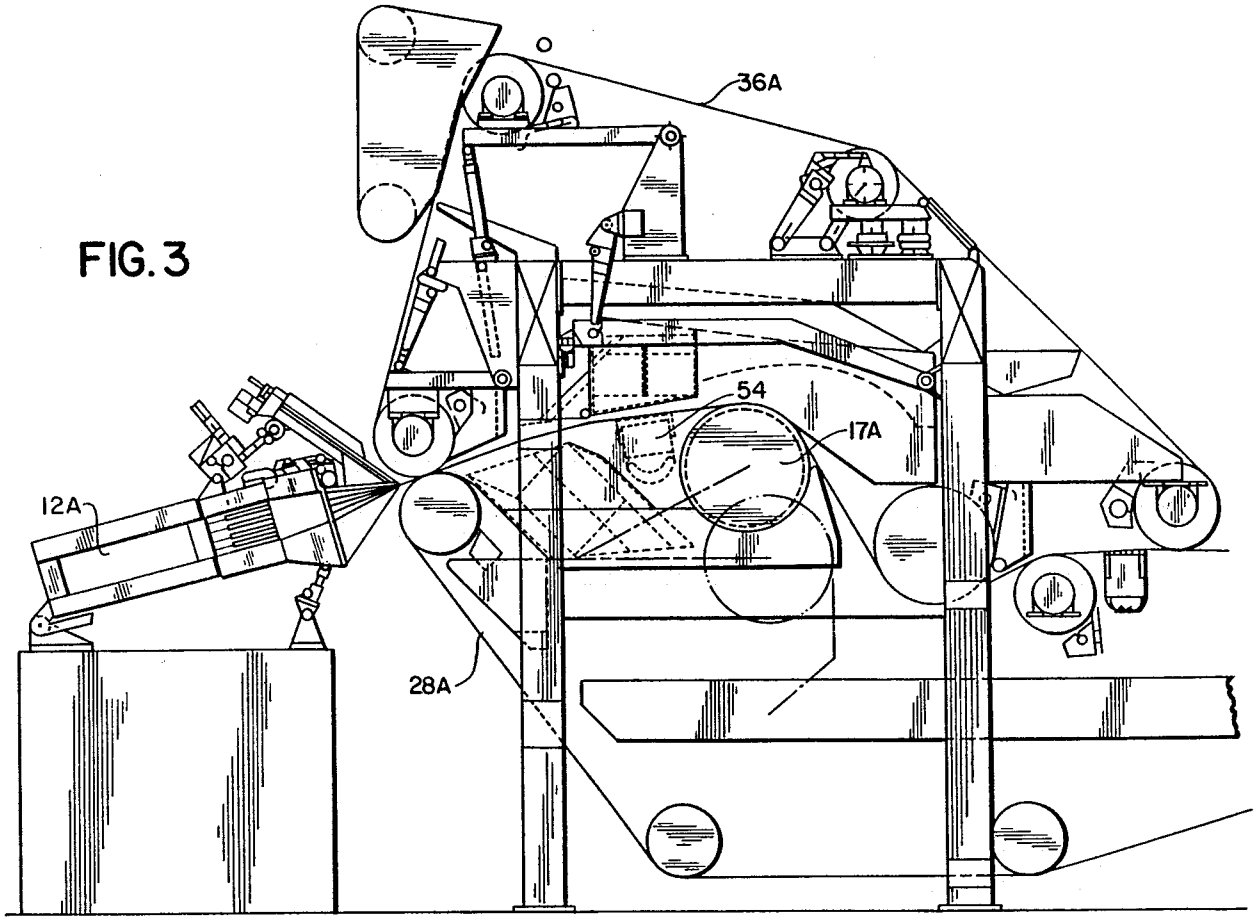
FIG. 3 is an enlarged side elevational view of a further embodiment of the present invention.

FIG. 3 shows an alternative embodiment of the present invention in which a polymeric-covered, grooved roll 17A is substituted for the suction roll 17 of the first embodiment. Such grooved roll 17A results in a reduction of cost as grooved rolls are less costly to manufacture than suction rolls. However, such substitution does not greatly reduce the efficiency of the present forming apparatus.

In both the embodiments of FIGS. 2 and 3, a radius top suction box 54 is shown below the first wire and between the collector means and the roll means for further reducing the moisture contents of the formed web by removing water through the first wire.

As shown in FIGS. 1–3 the wires wrap the roll 17 and travel downwardly to guide roll 31, and there are no dewatering elements within the second wire loop between vacuum slot 52 and roll 17 and guide roll 31.

Figure 4:
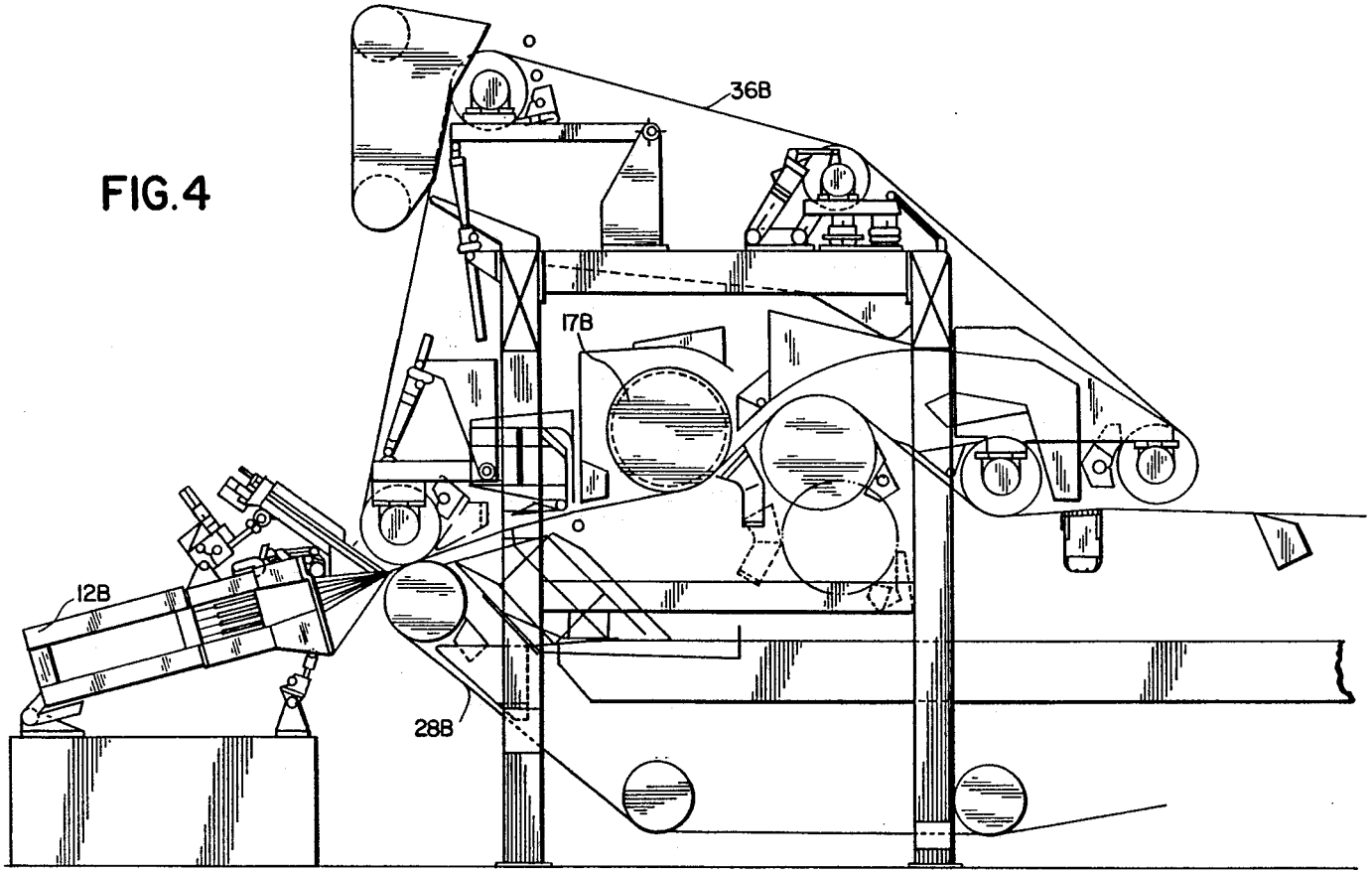
FIG. 4 is an enlarged side elevational view of yet another embodiment of the present invention showing the roll disposed above the second wire.

FIG. 4 shows yet a further embodiment of the present invention in which the roll means 17B, which may be a grooved roll, is disposed above the second wire 36B so that as the second wire 36B passes around the roll means 17B the third portion of water is removed from the stock through the first wire 28B.

In operation of the forming apparatus as shown in FIGS. 1 and 2, a jet of stock is directed from the headbox 12 towards the first end 40 of the forming section 38. The stock disposed between the first and second wires 28 and 36 respectively, moves towards the suction shoe 44 which is disposed below the first wire 28. The partial vacuum within the suction shoe 44 causes a gentle dewatering of the stock disposed between the first and second wire. However, due to the curved surface 46 of the dewatering means, or suction shoe 44, a second portion of water will be removed from the moving stock through the second wire 36 due to the centrifugal force of the stock moving around the curved surface 46. Such second portion of water is removed through the second wire 36 by means of the collector means, or vacuum slot 52. In the embodiment shown in FIGS. 1 and 2, the formed web disposed between the first and second wires 28 and 36 passes around the roll means, or suction roll 17 which is disposed below the first wire 28. The suction roll applies a greater suction to the moving wires and stock than the suction applied by the suction shoe 44 so that some of the remaining water within the formed web is drawn through the first wire 28 towards the suction roll 17. However, the suction roll 17 has a radius of curvature which is less than the radius of curvature of the suction shoe 44, therefore, as the stock passes around the suction roll 17, some of the water within the stock is thrown by centifugal force upwardly through the second wire 36. Therefore, the third portion of water removed from the formed web at the suction roll 17 is removed partially through the first wire 28 and partially through the second wire 36. In this way, dewatering of the stock from the first towards the second end of the forming section 38 gradually increases so that the removal of fines from the web is minimized and two-sidedness of the resultant web is inhibited.

In operation of the embodiment shown in FIG. 3, the suction roll 17 is replaced by a rubber-covered, grooved roll 17A so that the third portion of water is removed from the formed web through both the first and second wires. More specifically, some of the water passes through the first wire 28A into the plurality of grooves defined by the grooved roll 17A while some of the water is thrown through the second wire 36 due to the centrifugal force of the formed web passing around the grooved roll 17A which, like the roll 17, has a radius of curvature which is less than the radius of curvature of the suction shoe.

Operation of the embodiment shown in FIG. 4 is similar to the operation of the embodiment shown in FIGS. 2 and 3, however, FIG. 4 shows the roll means 17B which may be a grooved roll similar to the grooved roll 17A of FIG. 3, but with the roll means 17B disposed above the second wire 36B. In the embodiment shown in FIG. 4, some of the water will be removed from the formed web through the upper, or second, wire 36 and some of the third portion of water will be removed from the web through the first wire 38B due to the roll means 17B having a radius of curvature less than that of the suction shoe.

It should be appreciated by those skilled in the art that in each of the embodiments shown in FIGS. 2, 3 and 4, the gradual dewatering is effected between the first end of the forming section towards the roll means such that removal of fines from the formed web is minimized and two-sidedness of the resultant web is inhibited.

As will be appreciated by those skilled in the art, the foregoing embodiments are merely illustrative of some of the arrangements for carrying out the invention as defined by the appended claims. Many variations and modifications may be made by those skilled in the art without departing from the spirit and scope of the invention as defined by these appended claims.

What is claimed is:

1. A forming apparatus for forming a web from stock, said apparatus comprising:

a frame;

a first plurality of guide rolls rotatably connected to said frame;

a first continuous forming wire loop extending around, and guided by, said first plurality of rolls;

a second plurality of guide rolls rotatably connected to said frame;

a second continuous forming wire loop extending around, and guided by, said second plurality of rolls;

said first and second wires cooperating together to define therebetween a substantially horizontal forming section in which the web is formed, said forming section having a first and a second end;

a headbox disposed directly adjacent to, and upstream relative to said first end of said forming section such that the stock is ejected from said headbox towards said first end of said forming section so that the stock moves together with, and between, said wires and along said forming section in a direction from said first towards said second end of said forming section, said headbox being structured so that the stock impinges on said first wire prior to said second wire;

a dewatering shoe disposed adjacent to said first end of said forming section and downstream relative to said headbox for dewatering the web, said shoe being connected to a source of partial vacuum;

said dewatering shoe defining a curved surface which abuts against said first wire, said curved surface having a center of curvature disposed on the opposite side of said first wire relative to said second wire such that a first portion of water is removed from the stock through said first wire and said curved surface and a second portion of water is removed from the stock through said second wire due to the centrifugal force of the stock moving along said first wire as said first wire passes over said curved surface;

a vacuum slot disposed adjacent to said second wire for collecting said second portion of water, said vacuum slot being disposed adjacent to said second wire such that said wires are disposed between said vacuum slot and said dewatering shoe, said vacuum slot being connected to a source of partial vacuum;

a radius top suction box disposed downstream relative to said vacuum slot such that said wires are disposed between said vacuum slot and said suction box, said suction box further reducing the moisture content of the formed web by removing water through said first wire, said suction box being connected to a source of partial vacuum;

a roll disposed downstream relative to said suction box between said suction box and said second end of said forming section, said roll being disposed on the same side of said first wire as said dewatering shoe;

said wires wrapping said roll such that a third portion of water is removed from the stock through said second wire;

said roll having a radius of curvature which is less than the radius of curvature of said curved surface, such that when said wires move around and wrap said roll, said third portion of water is removed by centrifugal force from the stock through said second wire so that dewatering of the stock from said first towards said second end of said forming section gradually increases so that the removal of fines from the web is minimized and two-sidedness of the resultant web is inibited; and said second wire loop being devoid of dewatering elements between said vacuum slot and said roll.

2. A forming apparatus as set forth in claim 1 wherein said headbox is a hydraulic headbox which delivers a uniform jet of stock.

3. A forming apparatus as set forth in claim 2 wherein said headbox is disposed less than 13 inches (33 cms) from said first end of said forming section.

4. A forming apparatus as set forth in claim 2 wherein said headbox is structured so that said jet of stock impinges onto said first wire at an angle within the range 1–5 degrees relative to said forming section adjacent to said end thereof.

5. A forming apparatus as set forth in claim 1 wherein said curved surface of said dewatering shoe has a radius of curvature within the range of 100 to 300 inches (254–762 cms).

6. A forming apparatus as set forth in claim 1 wherein said curved surface of said dewatering shoe has a radius of curvature within the range of 150 to 250 inches (381–635 cms).

7. A forming apparatus as set forth in claim 1 wherein said roll is a suction roll.

8. A forming apparatus as set forth in claim 1 wherein said roll is a grooved roll.

9. A forming apparatus as set forth in claim 8 wherein said grooved roll is covered with a polymeric material.

* * * * *